US005759303A

United States Patent [19]

Mihalisin et al.

[11] Patent Number: 5,759,303

[45] Date of Patent: Jun. 2, 1998

[54] CLEAN SINGLE CRYSTAL NICKEL BASE SUPERALLOY

[75] Inventors: John R. Mihalisin, North Caldwell, N.J.; John Corrigan; Robert J. Baker, both of Yorktown, Va.; Eric L. Leonard, Rutherford, N.J.; Jay L. Vandersluis, Grand Haven, Mich.

[73] Assignee: Howmet Research Corporation, Whitehall, Mich.

[21] Appl. No.: 701,162

[22] Filed: Aug. 21, 1996

Related U.S. Application Data

[62] Division of Ser. No. 390,437, Feb. 16, 1995, Pat. No. 5,549,765, which is a continuation of Ser. No. 33,383, Mar. 18, 1993, abandoned.

[51] Int. Cl.[6] ..... C22C 19/05

[52] U.S. Cl. ..... 148/428; 420/448

[58] Field of Search ..... 148/404, 428, 148/410; 420/448

[56] References Cited

U.S. PATENT DOCUMENTS

| | | | |
|---|---|---|---|
| 3,567,526 | 3/1971 | Gell et al. . | |
| 3,620,852 | 11/1971 | Herchenroeder et al. . | |
| 4,116,723 | 9/1978 | Gell et al. . | |
| 4,209,348 | 6/1980 | Duhl et al. . | |
| 4,222,794 | 9/1980 | Schweizer et al. . | |
| 4,402,772 | 9/1983 | Duhl et al. . | |
| 4,643,782 | 2/1987 | Harris et al. . | |
| 4,719,080 | 1/1988 | Duhl et al. . | |
| 4,801,513 | 1/1989 | Duhl et al. . | |
| 5,100,484 | 3/1992 | Wukusick et al. | 148/404 |

FOREIGN PATENT DOCUMENTS

| | | |
|---|---|---|
| 0 240 451 | 7/1987 | European Pat. Off. . |
| 0 413 439 A1 | 2/1991 | European Pat. Off. . |
| 2234521 | 6/1991 | United Kingdom . |
| WO93/24683 | 9/1993 | WIPO . |

*Primary Examiner*—Deborah Yee
*Attorney, Agent, or Firm*—Edward J. Timmer

[57] ABSTRACT

A nickel base superalloy composition consisting essentially of, in weight %, 9.3–10.0% Co, 6.4–6.8% Cr, 0.5–0.7% Mo, 6.2–6.6% W, 6.3–6.7% Ta, 5.45–5.75% Al, 0.8–1.2% Ti, 0.07–0.12% Hf, 2.8–3.2% Re, and balance essentially Ni wherein a carbon concentration of about 0.01 to about 0.08 weight % is provided for improving the cleanliness of a single crystal investment casting produced therefrom.

3 Claims, 3 Drawing Sheets

CLEAN SINGLE CRYSTAL NICKEL BASE SUPERALLOY

This is a division of Ser. No. 08/390,437, filed Feb. 16, 1995 now U.S. Pat. No. 5,549,765 which is a Cont. of Ser. No. 08/033,383 filed Mar. 18, 1993 now abandoned.

FIELD OF THE INVENTION

The present invention relates to superalloys and, more particularly, to superalloys having improved cleanliness (i.e. a reduced non-metallic inclusion level).

BACKGROUND OF THE INVENTION

Clean, defect-free superalloy castings have been the objective in the gas turbine industry since it is well known that premature mechanical failure in superalloy castings primarily is attributable to the presence of non-metallic inclusions in the casting microstructure. Over the years, internally cooled high temperature cast turbine blades have been developed for use in the turbine section of the gas turbine engine. As a result, turbine blades have become more complex and airfoil wall cross-sections have become thinner and thinner. Unfortunately, microscopic inclusions which were relatively innocuous in simpler, relatively thick walled blade castings have become a limiting factor in the design of new complex, internally cooled, thin walled turbine blade castings.

Over this same time period, prior art workers also developed unidirectional casting techniques to produce single crystal turbine blade castings which exhibit improved mechanical properties at high temperatures as a result of the elimination of grain boundaries that were known to be the cause of high temperature equiaxed casting failure. Single crystal turbine blade castings are in widespread use today as a result.

Since single crystal castings do not include grain boundaries, prior art workers initially believed that elements, such as carbon, that form grain boundary strengthening precipitates in the microstructure would not be necessary in single crystal superalloy compositions. As a result, the concentration of carbon in single crystal superalloys was limited so as not to exceed relatively low maximum levels. For example, the carbon content of a certain nickel base superalloys, such as MAR-M200 and UDIMET 700, was controlled so as not exceed 100 ppm (0.01 weight %) in U.S. Pat. No. 3,567,526 to avoid formation of MC-type carbides that were believed to reduce the fatigue and creep resistance of the alloy castings. Similarly, U.S. Pat. No. 4,643,782 discloses controlling trace elements, such as C, B, Zr, S, and Si, so as not to exceed 60 ppm (0.006 weight %) in the hafnium/rhenium-bearing, single crystal nickel base superalloy known as CMSX-4.

However, the reduction of the carbon concentration to the low levels set forth above in single crystal superalloys ignored the role that carbon was known to play in vacuum induction melted superalloys where oxygen was known to be a chief source of contamination. For example, oxygen is present in the raw materials from which the alloys are made and in the ceramic crucible materials in which the alloys are melted. In particular, superalloy castings are generally produced by vacuum induction melting a superalloy charge and then vacuum investment casting the melt into suitable investment molds. In both of these processing stages, ceramic crucibles are used to contain the superalloy melt and are known to contribute to oxygen contamination of the alloy. Oxygen will react with elements, such as aluminum, present in the superalloy compositions to form harmful dross which can find its way into the casting as inclusions.

In particular, the major role of carbon in the vacuum induction melting and refining process (during master alloy formulation) was to remove oxygen from the melt. This refining action is conducted by what is called the "carbon boil" wherein carbon combines with oxygen in the melt to form carbon monoxide which is removed by the vacuum present during the induction melting operation. However, the low carbon levels present in single crystal superalloys at the heat formulation stage substantially negated the carbon boil previously present in the production of superalloys.

One single crystal nickel base superalloy was found to develop a problem of cleanliness in its production for single crystal turbine blade casting applications. This superalloy is described in U.S. Pat. Nos. 4,116,723 and 4,209,348 (designated ALLOY A hereafter) and comprised, in weight %, about 5.0% Co, 10.0% Cr, 4.0% W, 1.4% Ti, 5.0% Al, 12.0% Ta, 0.003% B, 0.0075% Zr, 0.00–0.006% C, and the balance Ni at the time the cleanliness problem was observed. In response to the cleanliness problem, the carbon content of the superalloy at the heat formulation stage was increased to 200 ppm (0.02 weight %) in an attempt to provide a carbon boil during the heat formulation stage. This was found to improve the cleanliness of single crystal superalloy castings produced from the modified alloy formulation. An alloy carbon content of 400 ppm yielded further improvement in alloy cleanliness. The carbon content of the alloy ingot and investment casting of this superalloy is now specified by the gas turbine manufacturer to be acceptable if in the range from 0 to 500 ppm maximum. The upper or maximum limit on carbon is specified by the manufacturer on the basis of preventing formation of carbide precipitates or particles in the single crystal investment casting.

It is an object of the present invention to provide nickel base superalloy compositions having carbon concentrations optimized for the particular alloy compositions involved, especially with respect to the concentrations of the strong carbide formers, titanium, tantalum, and tungsten present in a particular alloy composition.

SUMMARY OF THE INVENTION

The present invention involves the discovery that in order to achieve optimum cleanliness (i.e. reduced non-metallic inclusion levels) in vacuum induction melted single crystal nickel base superalloy melts and castings produced therefrom, the carbon concentration should be controlled within a specific range of values in dependence on a combination of factors not heretofore recognized. In particular, the carbon concentration is controlled in dependence on the need to effect a carbon boil to remove oxygen from the melt, the need to avoid excessive reaction of the carbon with ceramic crucible materials that could introduce excessive oxygen into the melt, and the amount of strong carbide formers, especially Ti, Ta, and W present in the superalloy composition. Thus, the carbon concentration is controlled to effect not only the carbon boil and limitation of excessive carbon/crucible ceramic reactions but also reaction between carbon and the aforementioned strong carbide formers present in the superalloy. Control of the carbon content of the superalloy composition in dependence on these factors is especially important for single crystal superalloy compositions given the relatively low carbon levels present.

In accordance with the present invention, the carbon concentration for a particular single crystal nickel base superalloy composition is controlled to provide a minimum carbon content to initiate the carbon boil and a maximum carbon content where carbon/crucible ceramic reactions would overpower the refining action of the carbon boil wherein these minimum and maximum carbon contents are affected by the amount of strong carbide formers present in the superalloy composition and are determined and controlled accordingly. Within the minimum and maximum carbon contents, there is an optimum carbon content for cleanliness dependent on the amount of strong carbide formers present in the superalloy composition.

In accordance with one embodiment of the invention, a Re-bearing, Ti-bearing single crystal nickel base superalloy composition has a composition consisting essentially of, in weight %, 9.3–10.0% Co, 6.4–6.8% Cr, 0.5–0.7% Mo, 6.2–6.6% W, 6.3–6.7% Ta, 5.45–5.75% Al, 0.8–1.2% Ti, 0.07–0.12% Hf, 2.8–3.2% Re, and balance essentially Ni and carbon wherein carbon is in the range of about 0.01 to about 0.08 weight % (100–800 ppm) for improving the cleanliness of a single crystal investment casting produced therefrom.

This superalloy composition can be provided in a remelt ingot so that vacuum induction remelting of the ingot will effect a carbon boil to reduce oxygen content of the remelt. This superalloy composition also can be provided in an investment casting produced from the remelted ingot.

For an ingot having this superalloy composition, control of the carbon content within the range set forth in accordance with the invention results in a tenfold improvement in the cleanliness; i.e. a tenfold reduction of non-metallic inclusions present, in the remelted ingot.

In one embodiment of the invention, the carbon content and the content of strong carbide formers, Ti, Ta, and W, in single crystal nickel base superalloys are in accordance with the relationship, $\%Ti+\%Ta+\%W=3.8+(10.5\times\%C)$, to improve the cleanliness of the alloy where %'s are in atomic %.

The aforementioned objects and advantages of the present invention will be more readily apparent from the following drawings and detailed description.

DETAILED DESCRIPTION

Figure 1:
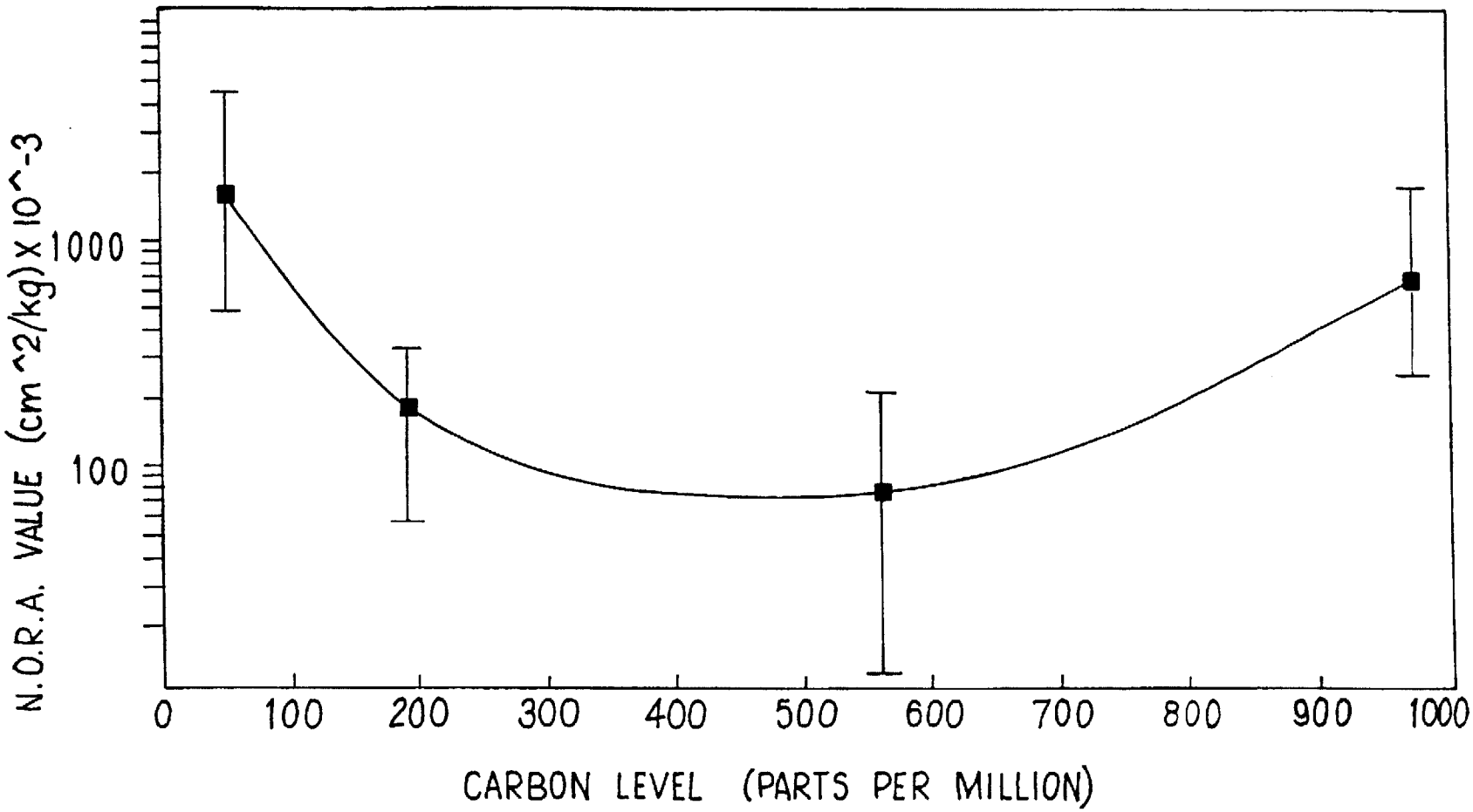
FIG. 1 is a graph of carbon content (ppm-parts per million) versus inclusion N.O.R.A. values ($cm^2/kg$ on a logarithmic scale) for one Re and Ti-bearing nickel base superalloy composition referred to as CMSX-4.

The carbon concentration for a particular single crystal nickel base superalloy composition is controlled pursuant to the invention to provide a minimum carbon content to initiate the carbon boil and a maximum carbon content where carbon/crucible ceramic reactions would overpower the refining action of the carbon boil with these minimum and maximum carbon contents also being controlled in dependence on the amount of strong carbide formers present in the superalloy composition. Within the minimum and maximum carbon contents, there is an optimum carbon content for cleanliness dependent on the amount of strong carbide formers present in the superalloy composition. The present invention will be illustrated, immediately below with respect to modification of the carbon levels of two single crystal nickel base superalloys known commercially as CMSX-4 and AM1. The CMSX-4 superalloy is a Re and Ti-bearing alloy to which the invention is especially applicable. The compositions of CMSX-4 and AM1 are set forth below, in weight %:

CMSX-4

9.3–10.0% Co, 6.4–6.8% Cr, 0.5–0.7% Mo, 6.2–6.6% W, 6.3–6.7% Ta, 5.45–5.75% Al, 0.8–1.2% Ti, 0.07–0.12% Hf, 2.8–3.2% Re, 0.0025% B maximum, 0.0075% Zr maximum, and balance essentially Ni and C wherein C is specified as 0.006% (60 ppm) maximum.

AM1

6.0–7.0% Co, 7.0–8.0% Cr, 1.8–2.2% Mo, 5.0–6.5% W, 7.5–8.5% Ta, 5.1–5.5% Al, 1.0–1.4% Ti, 0.01 maximum % B, 0.01 maximum % Zr, and balance essentially Ni and C wherein C is specified as 0.01% (100 ppm) maximum.

Four heats of CMSX-4 and four heats of AM1 were prepared with respective aim carbon levels of less than 60 (corresponding to commercial alloy specification), 200, 500, and 1000 ppm to test the effect of higher carbon contents. Each heat was cast into steel tube molds about 3.5 inches in diameter, producing an 80 pound alloy ingot from each steel mold. Each heat was vacuum induction melted in an alumina ceramic crucible at a vacuum of 5 microns using 100% revert material.

The analyzed chemical compositions of each ingot (heat) are set forth below in the Tables 1–8.

TABLE 1

| | | | | | | | | | |
|---|---|---|---|---|---|---|---|---|---|
| C<br>.0052% | Si<br>.02% | Mn<br>.01% | Co<br>9.49% | Ni<br>Bal. | Cr<br>6.22% | Fe<br>.05% | Mo<br>.58% | W<br>6.42% | P<br>.002% |
| Ti<br>.97% | Al<br>5.70% | Cb<br><.01% | Ta<br>6.49% | V<br>.02% | B<br>.0022% | S<br>.0007% | Zr<br><.01% | Cu<br><.01% | Hf<br>.08% |
| Pb | Bi | Ag | Se | Te | Tl | Mg<br>.0005% | N | O | Nv |
| Al + Ti | Cb + Ta | Ni + Co | W + Mo | Sn | Sb | Re<br>2.89% | Y<br>.001% | Pt<br>.02% | Zn |
| Cd | As | Ga | Th | In | H | Al + Ta<br>12.18% | | | |

TABLE 2

| | | | | | | | | | |
|---|---|---|---|---|---|---|---|---|---|
| C .0193% | Si .02% | Mn .01% | Co 9.52% | Ni Bal. | Cr 6.20% | Fe .06% | Mo .58% | W 6.52% | P .002% |
| Ti .95% | Al 5.65% | Cb .01% | Ta 6.40% | V .02% | B .0022% | S .0003% | Zr <.01% | Cu <.01% | Hf .08% |
| Pb | Bi | Ag | Se | Te | Tl | Mg <.0005% | N | O | Nv |
| Al + Ti | Cb + Ta | Ni + Co | W + Mo | Sn | Sb | Re 2.94% | Y .001% | Pt | Zn |
| Cd | As | Ga | Th | In | H | | | | |

TABLE 3

| | | | | | | | | | |
|---|---|---|---|---|---|---|---|---|---|
| C .0560% | Si .02% | Mn .01% | Co 9.47% | Ni Bal. | Cr 6.21% | Fe .04% | Mo .58% | W 6.38% | P .002% |
| Ti .97% | Al 5.69% | Cb <.01% | Ta 6.48% | V .02% | B .0021% | S .0003% | Zr <.01% | Cu <.01% | Hf .09% |
| Pb | Bi | Ag | Se | Te | Tl | Mg <.0005% | N | O | Nv |
| Al + Ti | Cb + Ta | Ni + Co | W + Mo | Sn | Sb | Re 2.89% | Y <.001% | Pt .01% | Zn |
| Cd | As | Ga | Th | In | H | Al + Ta 12.17% | | | |

TABLE 4

| | | | | | | | | | |
|---|---|---|---|---|---|---|---|---|---|
| C .0970% | Si .02% | Mn .01% | Co 9.47% | Ni Bal. | Cr 6.26% | Fe .05% | Mo .58% | W 6.28% | P .001% |
| Ti 1.00% | Al 5.75% | Cb <.01% | Ta 6.61% | V .02% | B .0021% | S .0004% | Zr <.01% | Cu <.01% | Hf .09% |
| Pb | Bi | Ag | Se | Te | Tl | Mg .0005% | N | O | Nv |
| Al + Ti | Cb + Ta | Ni + Co | W + Mo | Sn | Sb | Re 2.80% | Y <.001% | Pt .02% | Zn |
| Cd | As | Ga | Th | In | H | Al + Ta 12.36% | | | |

TABLE 5

| | | | | | | | | | |
|---|---|---|---|---|---|---|---|---|---|
| C .0131% | Si .04% | Mn .01% | Co 6.43% | Ni BAL. | Cr 7.44% | Fe .08% | Mo 2.01% | W 5.40% | P <.002% |
| Ti 1.29% | Al 5.30% | Cb <.01% | Ta 8.19% | V .01% | B .002% | S <.001% | Zr .005% | Cu <.001% | Hf <.01% |
| Pb | Bi | Ag | Se | Te | Tl | Mg <.0005% | N | O | Nv |
| Al + Ti | Cb + Ta | Ni + Co | W + Mo | Sn | Sb | Re .01% | Y .001% | Pt .24% | Zn |
| Cd | As | Ga | Th | In | H | | | | |

TABLE 6

| | | | | | | | | | |
|---|---|---|---|---|---|---|---|---|---|
| C<br>.0332% | Si<br>.04% | Mn<br>.01% | Co<br>6.60% | Ni<br>BAL. | Cr<br>7.39% | Fe<br>.09% | Mo<br>1.97% | W<br>5.68% | P<br><.002% |
| Ti<br>1.23% | Al<br>5.27% | Cb<br><.01% | Ta<br>7.89% | V<br>.01% | B<br>.002% | S<br><.001% | Zr<br>.003% | Cu<br><.001% | Hf<br><.01% |
| Pb | Bi | Ag | Se | Te | Tl | Mg<br><.0005% | N | O | Nv |
| Al + Ti | Cb + Ta | Ni + Co | W + Mo | Sn | Sb | Re<br>.04% | Y<br>.002% | Pt<br>.02% | Zn |
| Cd | As | Ga | Th | In | H | | | | |

TABLE 7

| | | | | | | | | | |
|---|---|---|---|---|---|---|---|---|---|
| C<br>.0558% | Si<br>.04% | Mn<br>.01% | Co<br>6.58% | Ni<br>BAL. | Cr<br>7.34% | Fe<br>.09% | Mo<br>1.98% | W<br>5.66% | P<br><.002% |
| Ti<br>1.23% | Al<br>5.28% | Cb<br><.01% | Ta<br>7.87% | V<br>.01% | B<br>.002% | S<br><.001% | Zr<br>.003% | Cu<br><.001% | Hf<br><.01% |
| Pb | Bi | Ag | Se | Te | Tl | Mg<br><.0005% | N | O | Nv |
| Al + Ti | Cb + Ta | Ni + Co | W + Mo | Sn | Sb | Re<br><.01% | Y<br>.002% | Pt<br>.02% | Zn |
| Cd | As | Ga | Th | In | H | | | | |

TABLE 8

| | | | | | | | | | |
|---|---|---|---|---|---|---|---|---|---|
| C<br>.0862% | Si<br>.04% | Mn<br>.01% | Co<br>6.55% | Ni<br>BAL. | Cr<br>7.37% | Fe<br>.10% | Mo<br>1.98% | W<br>5.59% | P<br><.002% |
| Ti<br>1.24% | Al<br>5.27% | Cb<br><.01% | Ta<br>7.90% | V<br>.01% | B<br>.002% | S<br><.001% | Zr<br>.003% | Cu<br><.001% | Hf<br><.01% |
| Pb | Bi | Ag | Se | Te | Tl | Mg<br><.0005% | N | O | Nv |
| Al + Ti | Cb + Ta | Ni + Co | W + Mo | Sn | Sb | Re<br>.01% | Y<br>.001% | Pt<br>.07% | Zn |
| Cd | As | Ga | Th | In | H | | | | |

As is apparent, each heat composition was close to the aim carbon level with the exception of the as-received AM1 heat which analyzed at 131 ppm C instead of the commercially specified 100 ppm maximum.

From each of the eight ingots (heats) of CMSX-4 and AM1, four samples (each weighing about 650 grams) were removed for EB (electron beam) button melting and determination of inclusion content. Four inclusion data points were thereby obtained for each carbon level for each alloy. A total of thirty two buttons were melted and tested for inclusion level.

The EB button test involved drip melting each 650 gram sample suspended above a water-cooled copper hearth into the hearth under a vacuum of 0.1 micron and melting the sample at a power level of 11.5 kilowatts. The melting program was controlled for about 8 minutes and produced a 450 gram sample in the shape of a large button hemispherical in shape.

Analysis of the EB buttons was conducted by taking optical photographs and measuring the area of non-metallic inclusions which float to the surface of the button since they are lighter than the alloy.

The results of the CMSX-4 and AM1 button samples are pressed as normalized oxide raft area (NORA) values ormalized to a constant weight) and are set forth in Tables 9 and 10 below.

TABLE 9

| S/N | Nora × $10^{-3}$ ($cm^2$/kg) |
|---|---|
| "As-Is" 52 pp C Actual | |
| 1 | 4499.02 |
| 2 | 722.50 |
| 3 | 484.80 |
| 4 | 592.49 |
| Average Nora Value | 1574.70 |
| Standard Deviation | 1690.45 |

TABLE 9-continued

| S/N | Nora × $10^{-3}$ ($cm^2$/kg) |
|---|---|
| "200" ppm C 193 ppm Actual | |
| 1 | 232.72 |
| 2 | 57.75 |
| 3 | 86.21 |
| 4 | 333.31 |
| Average Nora Value | 177.50 |
| Standard Deviation | 111.81 |
| "500" ppm C 560 ppm Actual | |
| 1 | 205.76 |
| 2 | 11.97 |
| 3 | 56.57 |
| 4 | 37.14 |
| Average Nora Value | 77.86 |
| Standard Deviation | 75.52 |
| "1000" ppm C 970 ppm Actual | |
| 1 | 409.57 |
| 2 | 258.81 |
| 3 | 1708.46 |
| 4 | 241.47 |
| Average Nora Value | 654.58 |
| Standard Deviation | 611.96 |

TABLE 10

| S/N | Nora × $10^{-3}$ ($cm^2$/kg) |
|---|---|
| "As-Is" 131 ppm C Actual | |
| 1 | 1385.93 |
| 2 | 1160.62 |
| 3 | 933.73 |
| 4 | 388.77 |
| Average Nora Value | 967.26 |
| Standard Deviation | 370.28 |
| "200" ppm C 332 ppm Actual | |
| 1 | 903.97 |
| 2 | 1249.98 |
| 3 | 638.85 |
| 4 | 387.82 |
| Average Nora Value | 795.15 |
| Standard Deviation | 319.78 |
| "500" ppm C 558 ppm Actual | |
| 1 | 637.24 |
| 2 | 1066.03 |
| 3 | 341.29 |
| 4 | 154.32 |
| Average Nora Value | 549.72 |
| Standard Deviation | 344.24 |
| "1000" ppm C 862 ppm Actual | |
| 1 | 951.28 |
| 2 | 841.46 |
| 3 | 1266.96 |
| 4 | 262.16 |
| Average Nora Value | 830.46 |
| Standard Deviation | 363.39 |

Figure 2:
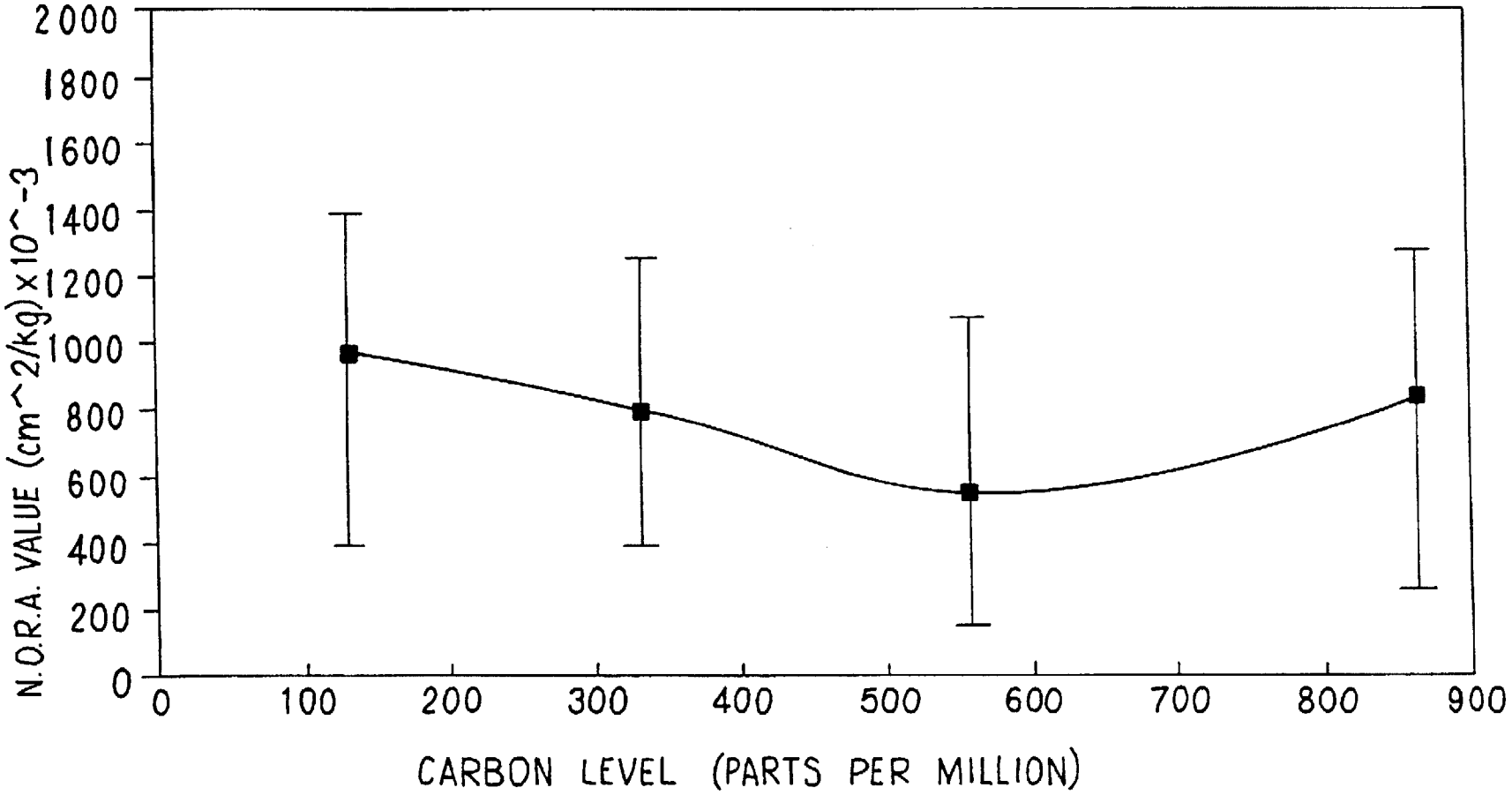
FIG. 2 is a graph of carbon content (ppm) versus inclusion N.O.R.A. values ($cm^2/kg$ on a linear scale) for another nickel base superalloy composition referred to as AMI.

The average NORA values as well as the maximum high and low values are illustrated for the CMSX-4 and AM1 samples in FIGS. 1 and 2, respectively.

Referring to FIG. 1, the CMSX-4 EB button samples show a trend of increasing cleanliness with increasing carbon concentrations. Importantly, there is observed an order of magnitude (tenfold) improvement (decrease in average NORA values) between the 113 ppm C sample and the 560 pm C sample. On the other hand, the 970 ppm C sample exhibits an increase in the average NORA values but the average NORA value is still slightly below that for the 113 ppm C sample. The increase in the average NORA value for the 970 ppm sample can be attributed to the carbon/ceramic crucible reaction competing with the carbon boil reaction and reducing its effectiveness.

From FIG. 1, it appears that the carbon range for improved cleanliness is about 400 ppm (0.04 weight %) to about 600 ppm (0.06 weight %). This C content range for optimum cleanliness contrasts to the C commercial specification of 60 ppm C maximum for the CMSX-4 alloy.

Referring to FIG. 2, the AM1 button samples show a similar trend of increasing cleanliness with increasing carbon concentrations. Importantly, there is observed a 50% reduction in average NORA values for the 558 ppm C sample as compared to the 131 ppm C sample. The observed effect of carbon content on cleanliness in the AM1 samples is less than that the effect observed in the CMSX-4 samples. The lesser beneficial effect of carbon on cleanliness can be attributed to the much higher carbon level (131 ppm) of the commercial-received sample. However, even then, a 50 % reduction in average NORA values is achieved for the 558 ppm C samples.

The 862 ppm C sample of AM1 exhibits an increase in the average NORA values but the average NORA value is still slightly below that for the 131 ppm C sample. The increase in the average NORA value for the 862 ppm sample can be attributed to the carbon/ceramic crucible reaction reducing the effectiveness of the carbon boil as was observed with the CMSX-4 alloy.

From FIG. 2, it appears that the carbon range for improved cleanliness is about 500 ppm (0.05 weight %) to about 600 ppm (0.06 weight %). This C content range for optimum cleanliness contrasts to the commercial C specification of 100 ppm C maximum for the AM1 alloy.

Referring to Tables 11 and 12, the nominal chemical compositions of single crystal nickel base superalloys and the carbon content for maximum cleanliness as determined by EB buttom samples and analysis methods described above for the CMSX-4 and AM1 alloys are shown in weight % and atomic %, respectively.

TABLE 11

(Chemical Composition Wt %)

| | ALLOY A* | ALLOY B* | CMSX-4 |
|---|---|---|---|
| C | 600 ppm | 200 ppm | 400 ppm |
| Co | 5.0 | 10.0 | 9.6 |
| Ni | Bal | Bal | Bal |
| Cr | 10.0 | 5.0 | 6.6 |
| Mo | — | 1.9 | .6 |
| W | 4.0 | 5.9 | 6.5 |
| Ti | 1.4 | — | 1.0 |
| Al | 5.0 | 5.7 | 5.6 |
| Ta | 12.0 | 8.7 | 6.5 |
| Re | — | 3.0 | 3.0 |
| Hf | — | .10 | .10 |

ALLOY A described in U.S. Pat. Nos. 4 116 723 and 4 209 348 and ALLOY B described in U.S. Pat. Nos. 4 719 080 and 4 801 513 with the exception of carbon content for maximum cleanliness.

*ALLOY A described in U.S. Pat. No. 4,116,723 and 4,209,348 and

*ALLOY B described in U.S. Pat. No. 4,719,080 and 4,801,513 with the exception of carbon content for maximum cleanliness.

TABLE 12

| | (Chemical Compositions - Atomic %) | | |
|---|---|---|---|
| | ALLOY A | ALLOY B | CMSX-4 |
| C | .3 | .1 | .2 |
| Co | 5.2 | 10.5 | 9.9 |
| Ni | Bal | Bal | Bal |
| Cr | 11.7 | 6.0 | 7.7 |
| Mo | — | 1.2 | .4 |
| W | 1.3 | 2.0 | 2.1 |
| Ti | 1.8 | — | 1.3 |
| Al | 11.2 | 13.1 | 12.6 |
| Ta | 4.0 | 3.0 | 2.2 |
| Re | — | 1.0 | 1.0 |
| Hf | — | .1 | .1 |

Figure 3:
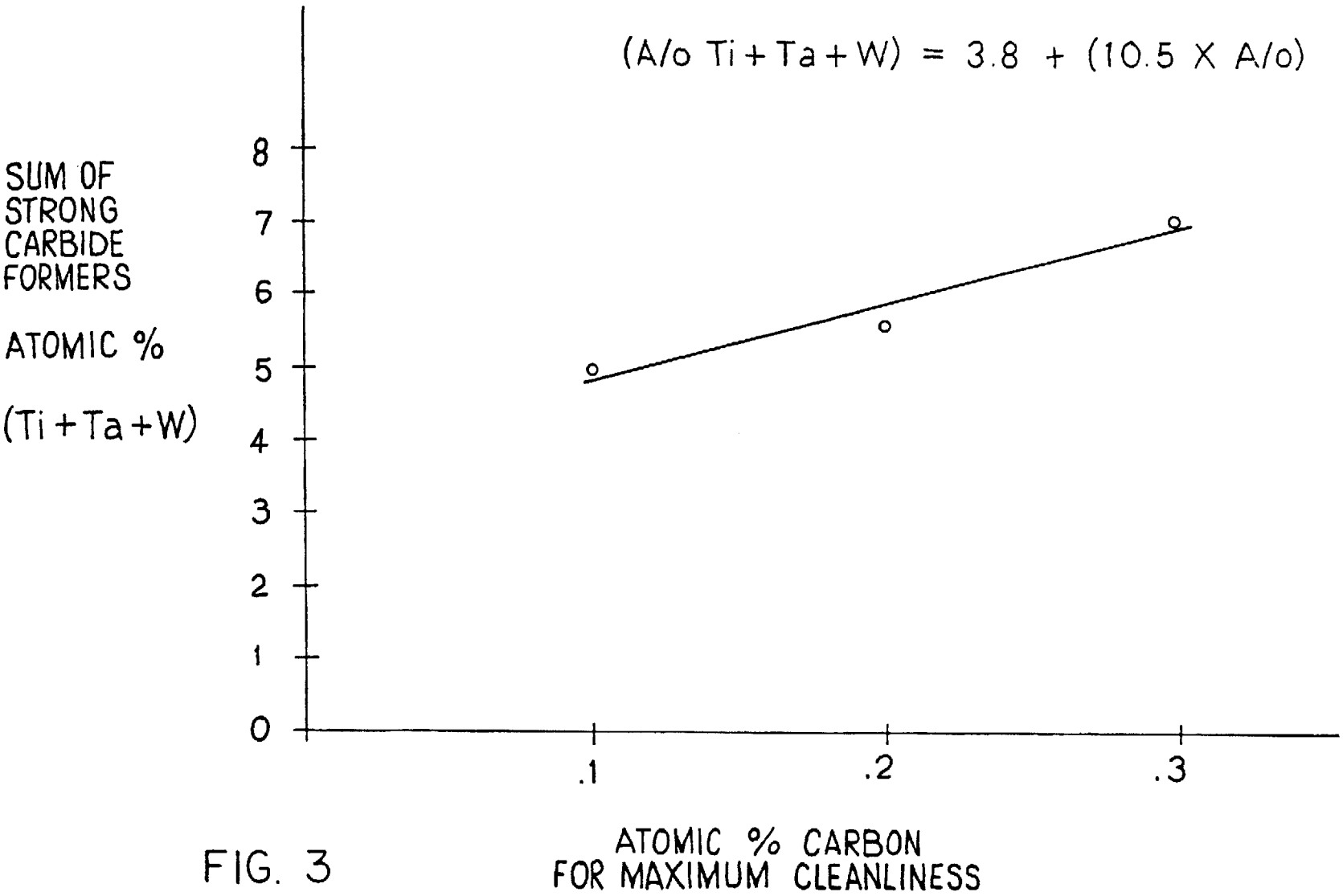
FIG. 3 is a graph of carbon content (atomic %) for maximum cleanliness versus the sum of Ti, Ta, and W (atomic %) strong carbide formers.

As mentioned above, the carbon content is controlled pursuant to the invention in dependence on the amount of strong carbide formers, Ti, Ta, and W present in the alloy composition. The effect is most clearly seen if the superalloy compositions are expressed in atomic %'s as set forth in Table 12, and the carbon content for maximum cleanliness plotted against the atomic % carbon as shown in FIG. 3 for the aforementioned single crystal superalloys. It will be seen that there is a direct relationship between the amount of strong carbide formers, Ti, Ta, and W and the carbon content for maximum alloy cleanliness. As a result, superalloys having relatively large contents of strong carbide formers (total strong carbide formers) will require larger carbon contents to sustain the carbon boil for maximum cleanliness. Yet, the carbon content should be limited to avoid excessive carbon/ceramic reactions that can introduce oxygen into the melt. For each superalloy composition, there thus is a range of carbon contents for improving cleanliness. FIGS. 1 and 2 discussed above illustrate these effects for the Re and Ti-bearing CMSX-4 alloy and the AM1alloy.

In particular, the carbon content for a particular nickel base superalloy having Ti, Ta, and W as strong carbide formers is provided in accordance with the relationship, $\%Ti+\%Ta+\%W=3.8+(10.5\times\%C)$, to improve the cleanliness of the alloy, where %'s are in atomic %.

FIG. 1 illustrates that the invention is effective in improving the cleanliness of the Re, Hf and Ti-bearing CMSX-4 alloy. As mentioned above, this alloy currently has a specification for a carbon maximum of only 60 ppm as compared to the 400 ppm C that the invention provides for maximum cleanliness; i.e. a tenfold reduction in NORA value.

Although in the examples set forth above, alloy melting was carried out in ceramic crucibles, the invention is not so limited and can be practiced using other melting techniques, such as electron beam cold hearth melting (refining) where water cooled metal (e.g. copper) melt vessels are employed. Control of the alloy carbon content in accordance with the invention will be useful in practicing such melting techniques to improve alloy cleanliness.

Although the invention has been described in terms of specific embodiments thereof, it is not intended to be limited thereto but rather only as set forth in the appended claims.

The embodiments of the invention in which an exclusive property or privilege is claimed are defined as follows:

1. A nickel base superalloy composition consisting essentially of, in weight %, 6.0–7.0% Co, 7.0–8.0% Cr, 1.8–2.2% Mo, 5.0–6.0% W, 7.5–8.5% Ta, 5.1–5.5% Al, 1.0–1.4% Ti, and balance essentially Ni and carbon wherein a carbon concentration of about 0.05 to 0.06 weight % is provided for reducing non-metallic inclusion levels of a single crystal casting produced therefrom.

2. A remelt ingot having the composition of claim 1 so that remelting of the ingot will effect a carbon boil to reduce oxygen content of the remelt.

3. A single crystal investment casting having the composition of claim 1.

* * * * *